US006516956B2

(12) United States Patent
Martorella et al.

(10) Patent No.: US 6,516,956 B2
(45) **Date of Patent: *Feb. 11, 2003**

(54) DEVICE FOR DRYING OBJECTS

(75) Inventors: Rudolph Martorella, 2 Spruce St., Apt. 4A, Great Neck, NY (US) 11021; R. Christopher Kidd, New York, NY (US)

(73) Assignee: Rudolph Martorella, Great Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/090,307

(22) Filed: Mar. 4, 2002

(65) Prior Publication Data

US 2002/0084233 A1 Jul. 4, 2002

Related U.S. Application Data

(63) Continuation-in-part of application No. 09/568,915, filed on May 11, 2000, now Pat. No. 6,357,605, and a continuation-in-part of application No. 09/757,216, filed on Jan. 9, 2001.

(51) Int. Cl.[7] ..... A47G 19/08

(52) U.S. Cl. ..... 211/41.6; 211/41.5

(58) Field of Search ..... 211/41.5, 41.6, 211/41.2–41.4, 2, 133.5, 132.1, 70.7, 85.25, 90.03, 106, 119.003, 181.1; D32/55–57; 248/448–449, 454–457, 463–465, 465.1

(56) References Cited

U.S. PATENT DOCUMENTS

| | | | | | |
|---|---|---|---|---|---|
| 378,692 | A | * | 2/1888 | Latham | 211/198 |
| 815,480 | A | * | 3/1906 | Silven | 248/455 |
| 990,454 | A | * | 4/1911 | Peters | 211/41.5 |
| 1,564,594 | A | * | 12/1925 | Leh | 248/448 |
| 1,712,342 | A | * | 5/1929 | Fitzgerald | 211/180 |
| 1,714,629 | A | * | 5/1929 | Rodin | 211/41.5 |
| 1,822,087 | A | * | 9/1931 | Feingold | 211/198 |
| 2,443,404 | A | * | 6/1948 | Tallarico | 211/41.4 |
| 2,479,118 | A | * | 8/1949 | Jenness | 211/195 |
| 2,516,088 | A | * | 7/1950 | Einhorn | 211/41.5 |
| 2,708,037 | A | * | 5/1955 | Planeta | 211/41.4 |
| 2,841,288 | A | * | 7/1958 | Field et al. | 211/41.4 |
| 2,936,898 | A | * | 5/1960 | Miguez | 211/41.3 |
| 2,958,424 | A | * | 11/1960 | Bigatti | 211/104 |
| 3,025,967 | A | * | 3/1962 | Christophersen | 211/41.5 |
| 3,027,041 | A | * | 3/1962 | Stansbury, Jr. et al. | 211/41.3 |
| 3,464,566 | A | * | 9/1969 | Gilson | 211/41.5 |
| 4,169,638 | A | * | 10/1979 | Cirasuolo et al. | 211/41.6 |
| 4,726,475 | A | * | 2/1988 | Ferenzi | 211/41.5 |
| 4,756,582 | A | * | 7/1988 | Heien | 211/41.4 |
| 4,969,560 | A | * | 11/1990 | Stanfield | 211/175 |
| 5,119,943 | A | * | 6/1992 | Hoang | 211/168 |
| 5,332,105 | A | * | 7/1994 | Stanfield | 211/4 |
| 5,480,035 | A | * | 1/1996 | Smith | 211/168 |
| 5,485,927 | A | * | 1/1996 | Hubbard | 211/41.3 |
| 5,503,279 | A | * | 4/1996 | Wentworth | 211/150 |
| 5,651,525 | A | * | 7/1997 | Yang | 248/456 |
| 6,170,676 | B1 | * | 1/2001 | Patadia et al. | 211/41.3 |
| 6,179,134 | B1 | * | 1/2001 | Pine et al. | 211/41.3 |
| 6,357,605 | B1 | * | 3/2002 | Martorella | 211/41.5 |

* cited by examiner

*Primary Examiner*—Daniel P. Stodola
*Assistant Examiner*—Jennifer E. Novosad
(74) *Attorney, Agent, or Firm*—Collard & Roe, P.C.

(57) ABSTRACT

A device for supporting objects for drying. This device contains a catch basin, for receiving fluid that drips off of these drying objects. Attached to the catch basin is a multi-part rack, wherein each part has a front end and a back end. The back end of each part of the multi-part rack is rotatably supported within the catch basin. In addition, there is also a complementary rack. This complementary rack is rotatably attached to the catch basin and extends in a substantially upright or vertical position. Both the multi-part rack and the complementary rack are comprised of a series of parallel extending slats that are spaced apart from each other to receive a plate between these parallel extending slats. These parallel extending slats are also designed to support a series of pots on either the multi-part rack or the complementary rack wherein these parallel extending slats allow water to drip down through the slats and into the catch basin.

11 Claims, 5 Drawing Sheets

DEVICE FOR DRYING OBJECTS

CROSS REFERENCE TO RELATED APPLICATIONS

This application is a continuation in part of U.S. patent application Ser. No: 09/568,915 filed on May 11, 2000, now U.S. Pat. No. 6,357,605; and U.S. patent application Ser. No. 09/757,216 Filed on Jan. 9, 2001 wherein priority is claimed under 35 U.S.C. §120 and wherein these applications are incorporated herein by reference.

BACKGROUND OF THE INVENTION

Field of the Invention

The invention relates to a device for supporting objects for drying. More particularly, this invention relates to an adjustable device that is designed to allow plates, pots, kitchen utensils and silverware to dry.

SUMMARY OF THE INVENTION

The invention relates to a device for supporting objects for drying. This device contains a catch basin, for receiving water that drips off of these drying objects. Attached to the catch basin is a multi-piece rack. This horizontal rack has a front end and a back end wherein the back end is rotatably supported within the catch basin. In addition, there is also a complementary rack that is rotatably attached to the catch basin. Both the rack and the complementary rack contain a series of parallel extending slats that are spaced apart from each other to receive a plate there between. The slats are spaced far enough apart so that they allow water to drip down through the bars and into the catch basin.

In addition, coupled to each piece of the multi-piece rack are U-shaped legs. These legs are for rotatably adjusting the height of the front end of this rack. Furthermore, disposed within the catch basin is a series of support strips or tabs wherein the support tabs are designed to support the legs in a particular position to keep these legs from rotating when the support bar is supporting the rack.

This device is also designed to prevent any water or other materials from flowing onto a counter top outside of the catch basin. For example, when in use, the catch basin contains a series of substantially vertical walls to trap this water within the catch basin. In this way, the water will not flow outside of the catch basin and onto a counter top. However, there are at least two drainage holes disposed within the substantially vertical walls to allow a user to easily pour out the water disposed within the catch basin into a sink.

The device also contains an adjustable tray attached to the catch basin for supporting a series of utensils. The adjustable tray also comprises a set of adjustable legs rotatably attached to the catch basin, and a top plate attached to the adjustable legs, wherein this top plate has holes for supporting the silverware and utensils in an upright manner. The top plate is adjustable from a folded up position to a folded down position so that the tray can be stored easily.

One of the benefits of this invention is that it can be folded down into a storage position wherein the rack can then be stored away. To facilitate this feature, there is also a catch block disposed within the catch basin wherein this catch block is designed to receive a top end of the complementary rack to lock the complementary rack in place on the catch block.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1A:
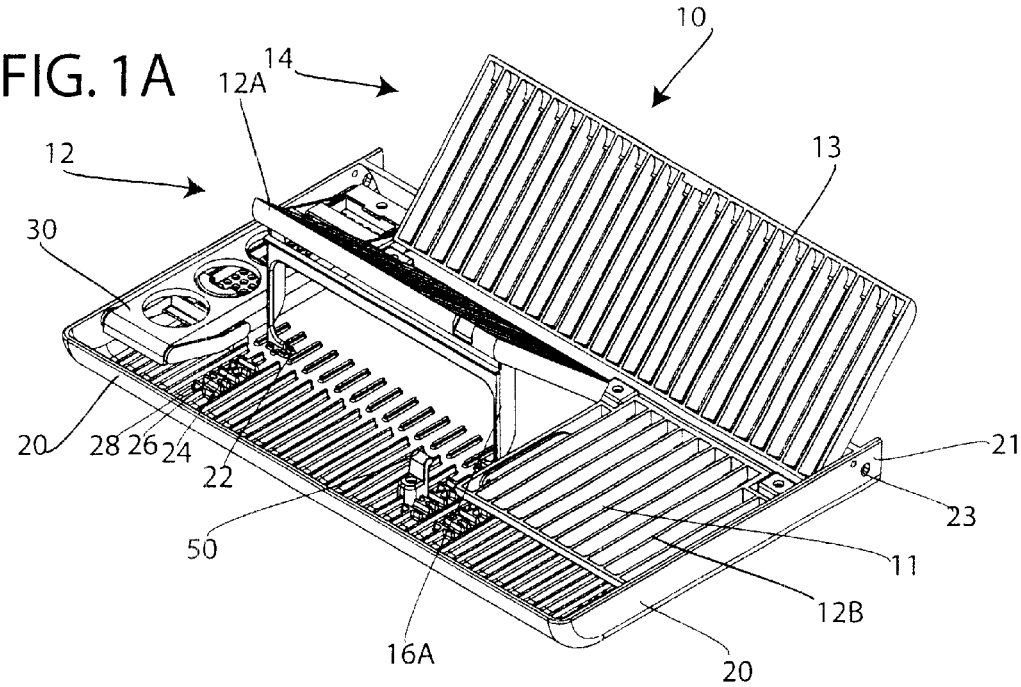
FIG. 1A presents a perspective view of the invention in its upright position supporting plates, a pot, and silverware for drying.
Figure 2:
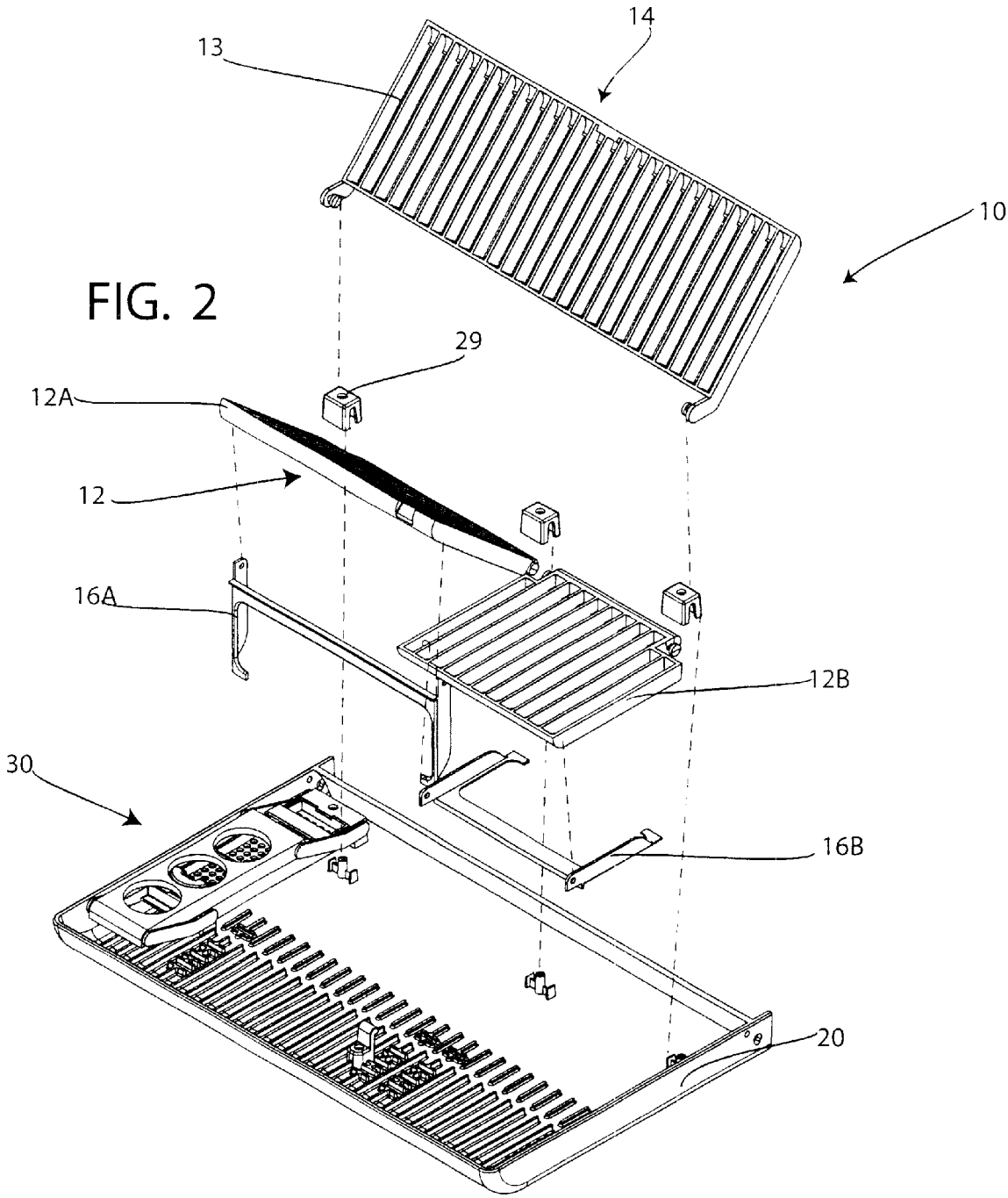
FIG. 2 represents an exploded view of the rack shown in FIG. 1.
Figure 3:
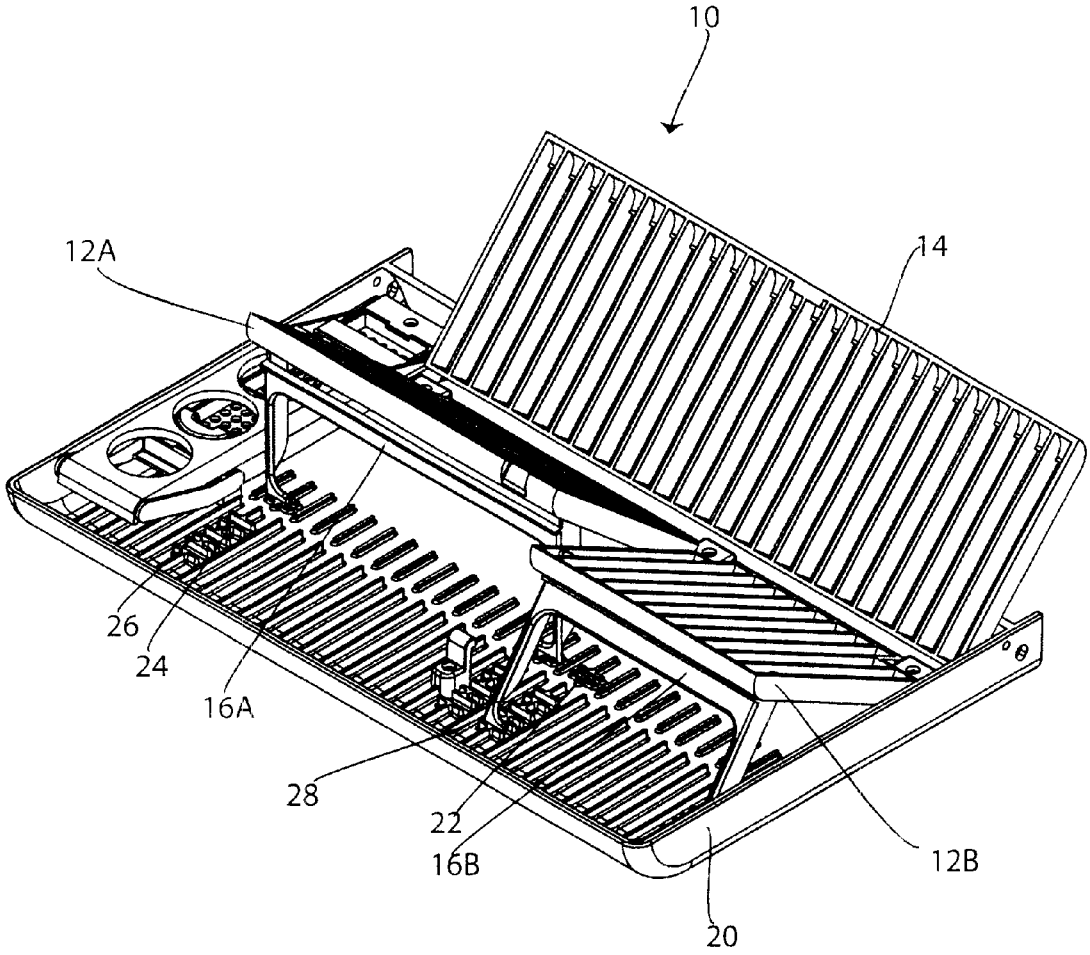
FIG. 3 shows a view of the rack shown in FIG. 1 wherein in this view, the multi-part rack is positioned in an offset manner.

FIG. 1A refers to a perspective view of the invention wherein there is shown a device 10 for drying plates, pots and silverware. There is a first part 12*a* of a multi-part rack 12 wherein this rack is rotatably attached to a catch basin 20. This can be better seen in FIG. 2 wherein clamping blocks 29 are used to rotatably secure multi-part rack 12 to basin 20. A second part 12B is also shown wherein this second part 12B can be folded up or down separate from first part 12A. There is also a complementary rack 14 rotatably attached to catch basin 20. Both rack 12 and complementary rack 14 contain a series of parallel extending slats 11 and 13 respectively. These parallel extending slats 11 and 13 are spaced apart to receive a series of plates or at least one pot not shown. These parallel extending bars 11 and 13 are spaced apart to allow water to drip off of pots and into catch basin 20. Water can then be drained from catch basin 20 via a drainage hole 23 positioned on a side wall of catch basin 20.

Rotatably coupled to first part 12A are substantially U-shaped support legs 16A, that support first part 12A above catch basin 20. These legs can be held in place and kept from rotating when positioned against one or more of a series of support strips 22, 24, 26, and 28 positioned within catch basin 20.

Figure 1B:
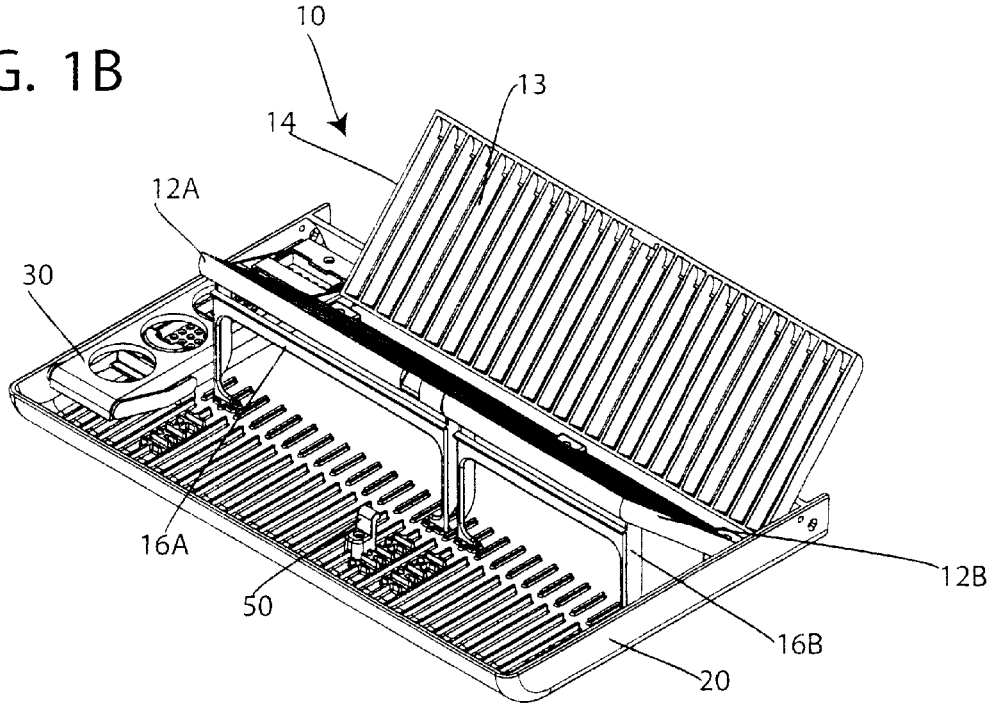
FIG. 1B represents a perspective view of the invention wherein the multi-part rack is set at the same position.

As shown in FIG. 1B rack 12 can be adjusted so that first part 12A moves separate from second part 12B wherein these parts can be matched together at a substantially similar angle. With this view, substantially U-shaped support legs 16B are shown coupled to second part 12B. U-shaped support legs 16B function similar to support legs 16A wherein these support legs are also held in place by support strips 22, 24, 26, and 28.

The elevation of the second end of racks 12A and 12B can be set by setting support legs 16A and 16B within one of three different support strips or tabs 22, 24, 26 and 28 designed to receive legs 16A and 16B. These support tabs extend parallel across the catch basin 20 so that the legs 16A and 16B can rest against each support strip to position the second end of multi-part rack 12 at varying heights. The legs 16A and 16B are pushed against each support tab by a gravitational force exerted by rack 12A or 12B. In addition, if there are any plates, or pots placed on racks 12A or 12B, these items also exert an additional gravitational force on legs 16A and 16B to further set legs 16A and 16B against one of support strips or tabs 22, 24, 26 or 28.

By elevating the second end of racks 12A and 12B this narrows the distance between rack 12 and rack 14 so that different sized plates or pots can fit snugly between parallel extending strips 11 and 13 on both rack 12 and rack 14. In addition, disposed adjacent to rack 12 and rack 14, is a tray 30 designed to support kitchen utensils and silverware (not shown) in an upright position.

Both the tray 30, racks 12A and 12B, rack 14 and legs 16A and 16B can be folded down so that the device 10 can be collapsed into a substantially flat position. Once folded down, racks 12 and 14 can be held in place using a catch block 50 which snaps over a top end of rack 14 when it is folded down. When device 10 is in its substantially flat position, catch basin 20 can be folded up to be free standing upright on legs 21 of catch basin 20. In this way, once device 10 has been fully collapsed, and turned on its end, device 10 only takes up a minimal amount of counter space.

As shown in U.S. patent application Ser. No. 09/568,915 catch basin 20 can be folded up in a substantially vertical manner wherein the entire device can be positioned in an upright manner so that it can stand freely on a flat surface. The components of device 10 are positioned within catch basin 20 so that when racks 12, 14, and tray 30 are collapsed for storage it forms a balanced device that can be supported upright by legs 21 on catch basin 20.

Figure 4:
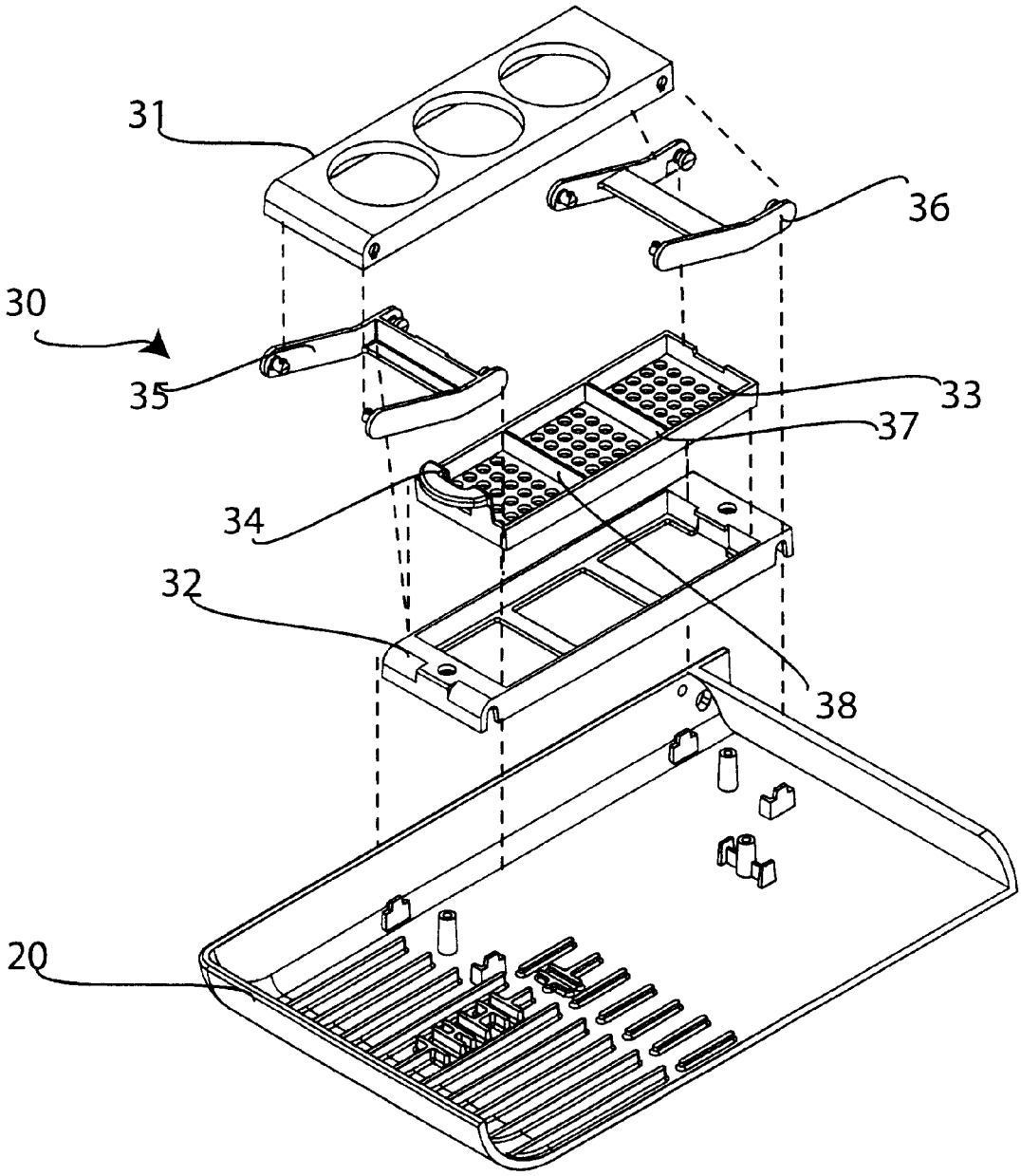
FIG. 4 shows an exploded perspective view of the utensil rack according to the invention.

FIG. 4 shows the utensil rack 30 in an exploded view. Utensil rack 30 contains a top tray 31, a bottom tray 32 and an intermediate removable drainage tray 33. Drainage tray 33 fits snugly inside of bottom tray 32 and is removable therefrom. Drainage tray 33 also has a tab 34 which allows a user to easily remove drainage tray 33 from bottom tray 32. In addition drainage tray 33 is formed in a mesh type pattern wherein this tray has a plurality of holes allowing water or other materials to flow out. In addition drainage tray 33 has dividers 37 and 38 which divide drainage tray 33 into different compartments to correspond with holes in top tray 31 for receiving utensils. Utensil rack 30 also contains a plurality of legs 35 and 36 which attach top tray 31 to bottom tray 32.

Figure 5:
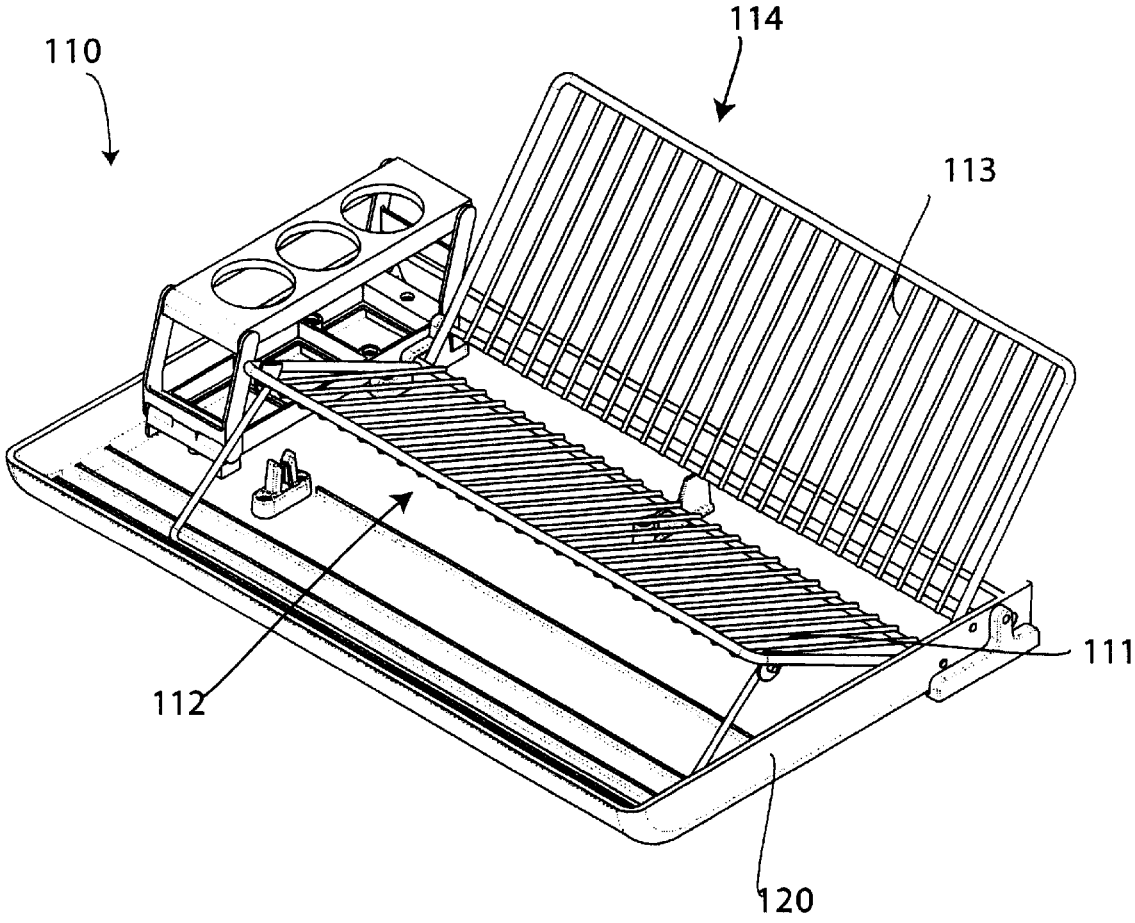
FIG. 5 shows a perspective view of the previous model of the invention.

FIG. 5 shows a perspective view of the previous embodiment of the invention shown in U.S. patent application Ser. No. 09/757,216 incorporated herein by reference. This device 110 contains a catch basin 120 and also a first rack 112 and a second rack 114. With this design these racks are not multi-part racks as in the present invention and the racks 112 and 114 contain a plurality of rods 111 and 113 respectively rather than a plurality of slats. Thus rods 111 and 113 and slats 11 and 13 or any other appropriately shaped elements are elongated support elements for supporting plates, dishes pots or pans above a basin or any other type surface.

Accordingly, while several embodiments of the present invention have been shown and described, it is to be understood that many changes and modifications may be made thereunto without departing from the spirit and scope of the invention as defined in the appended claims.

What is claimed is:

1. A device for supporting objects for drying comprising:

a) a catch basin;

b) at least one multi-part rack having a plurality of racks wherein each of said plurality of racks has a front end and a back end and wherein each of said back ends is attached to said catch basin;

c) a complementary rack rotatably attached to said catch basin, said complementary rack and said at least one multi-part rack are for supporting the objects wherein said multi-part rack and said complementary rack each comprise a series of substantially parallel extending slats wherein said substantially parallel extending slats are spaced apart a sufficient distance to receive a plate therebetween;

d) a plurality of adjustable legs rotatably attached to at least one part of said multi-part rack, wherein said plurality of legs are for rotatably adjusting a height of said front end of said multi-part rack; and e) a catch block adapted to receive a front end of said complementary rack to lock said complementary rack on top of said multi-part rack and into a collapsed position so that the device can be folded upright on a counter top.

2. The device as in claim 1, further comprising a series of support strips disposed within said catch basin wherein said support strips are designed to support said plurality of legs in a position to keep said plurality of legs from rotating when said plurality of legs are supporting said multi-part rack.

3. The device as in claim 1, wherein said catch basin contains a plurality of substantially vertical walls to enclose said catch basin.

4. The device as in claim 1, further comprising an adjustable tray attached to said catch basin for supporting a series of utensils.

5. The device as in claim 4, wherein said adjustable tray is adjustable so as to fold down into said catch basin.

6. The device as in claim 4, wherein said adjustable tray comprises a top tray, a bottom tray, an intermediate removable tray and a plurality of legs wherein said bottom tray is coupled to said catch basin, said top tray is coupled to said bottom tray via said legs and said intermediate removable tray fits inside said bottom tray.

7. The device as in claim 6, wherein said intermediate removable tray includes a plurality of holes to allow said intermediate removable tray to drain water when removed from said bottom tray.

8. The device as in claim 7, wherein said intermediate removable tray further comprises a tab for allowing a user to remove said intermediate removable tray from said bottom tray.

9. The device as in claim 1, wherein said multi-part rack, said complementary rack, and said plurality of legs are adjustable to collapse into said catch basin.

10. The device as in claim 1, wherein said catch basin contains at least one relief hole disposed within said catch basin designed to allow water to be drained out of said catch basin.

11. A device for supporting objects for drying comprising:

a) a basin;

b) at least one multi-part rack having a plurality of racks wherein each rack has a front end and a back end wherein each of said back ends is attached to said basin;

c) a complementary rack rotatably attached to said basin said complementary rack and said at least one multi-part rack are for supporting the objects wherein said multi-part rack and said complementary rack each comprise a plurality of elongated support elements which are spaced apart from each other a sufficient distance to receive a plate therebetween;

d) a plurality of adjustable legs rotatably attached to at least one part of said multi-part rack, wherein said plurality of legs are for rotatably adjusting a height of said front end of said multi-part rack; and e) a catch block adapted to receive a front end of said complementary rack to lock said complementary rack on top of said multi-part rack and into a collapsed position so that the device can be folded upright on a counter top.

* * * * *